US008814623B2

(12) United States Patent
Garcia

(10) Patent No.: US 8,814,623 B2
(45) Date of Patent: Aug. 26, 2014

(54) BUBBLE MAKING WAND

(71) Applicant: Fernando Garcia, Oswego, IL (US)

(72) Inventor: Fernando Garcia, Oswego, IL (US)

( * ) Notice: Subject to any disclaimer, the term of this patent is extended or adjusted under 35 U.S.C. 154(b) by 54 days.

(21) Appl. No.: 13/733,127

(22) Filed: Jan. 2, 2013

(65) Prior Publication Data

US 2013/0171904 A1 Jul. 4, 2013

Related U.S. Application Data

(60) Provisional application No. 61/582,610, filed on Jan. 3, 2012.

(51) Int. Cl.
*A63H 33/28* (2006.01)
*A47L 13/36* (2006.01)

(52) U.S. Cl.
USPC ..... 446/15

(58) Field of Classification Search
USPC ..... 446/15, 16, 17, 18, 19, 20, 21; 15/141.1
See application file for complete search history.

(56) References Cited

U.S. PATENT DOCUMENTS

| | | | | | |
|---|---|---|---|---|---|
| 745,434 | A * | 12/1903 | Hammond | ..... | 15/141.1 |
| 3,064,387 | A * | 11/1962 | Campbell | ..... | 446/21 |
| 6,764,370 | B2 * | 7/2004 | Bitton | ..... | 446/16 |
| 7,244,161 | B2 * | 7/2007 | Thai | ..... | 446/15 |
| 7,476,139 | B2 * | 1/2009 | Thai | ..... | 446/15 |
| 7,524,230 | B2 * | 4/2009 | Thai | ..... | 446/15 |

* cited by examiner

*Primary Examiner* — Kien Nguyen
(74) *Attorney, Agent, or Firm* — Reinhart Boerner Van Deuren P.C.

(57) ABSTRACT

A bubble wand device that includes an elongated handle and a pair of helical coils with a pair of smooth surface wires, a center core and a hollow space. The pair of helical coils are wound and placed in a circular configuration and provide a tapered surface to allow a bubble making solution to adhere to the hollow space between the pair of helical coils, with the center core providing a reservoir to retain the bubble making solution. The bubble wand device also includes a plurality of inner spires that protrudes from the center core of the pair of helical coils where the inner spires increase bubble production from the pair of helical coils which suspend the bubble making solution.

20 Claims, 1 Drawing Sheet

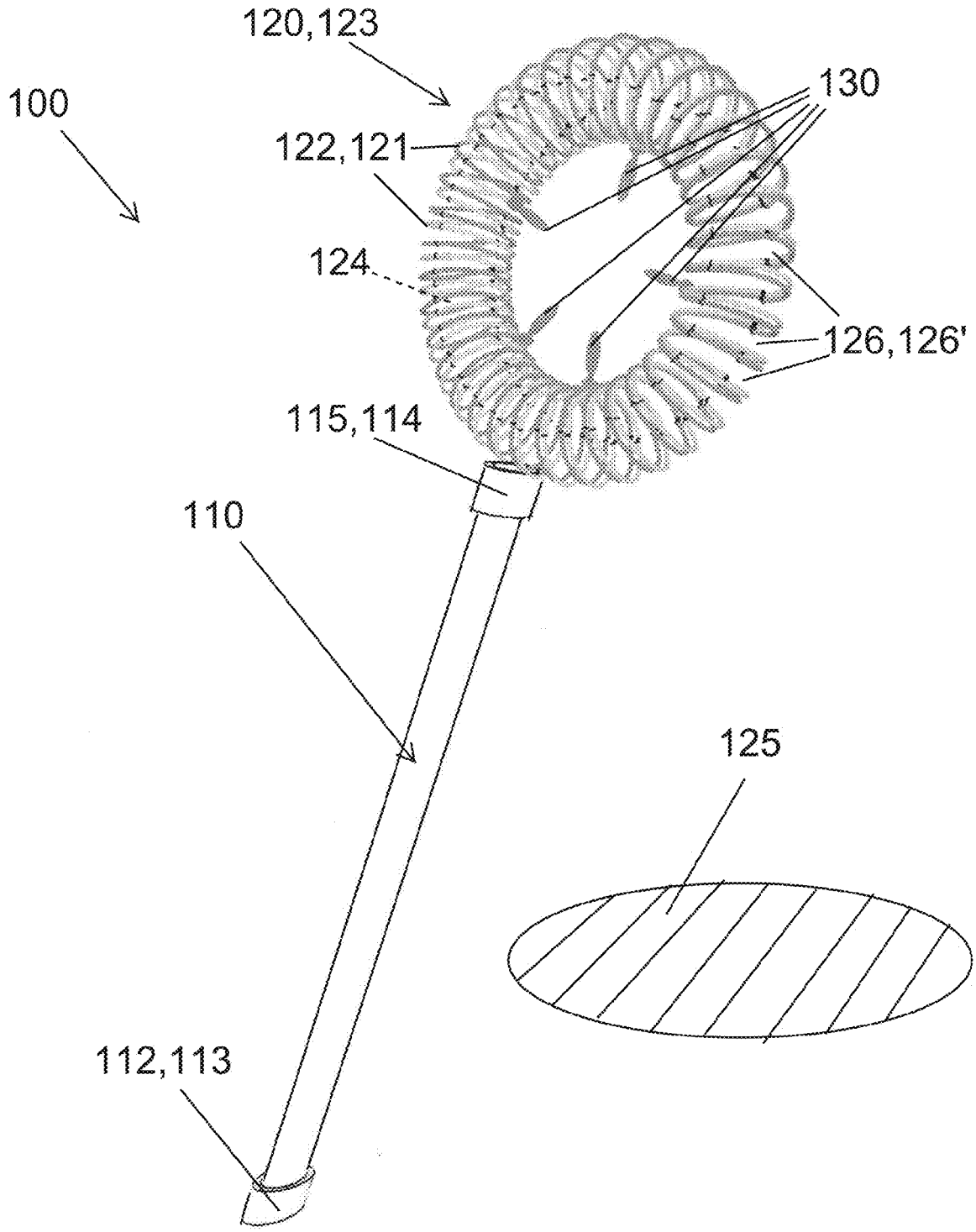
120,123
100
130
122,121
124
126,126'
115,114
110
125
112,113

BUBBLE MAKING WAND

This application claims priority to U.S. Provisional Application 61/582,610 filed on Jan. 3, 2012, the entire disclosure of which is incorporated by reference.

BACKGROUND OF THE INVENTION

1. Field of the Invention

The present invention is a bubble making device. More specifically, the present invention is a bubble making wand.

2. Description of the Related Art

Bubble making wands have been manufactured and are made of smooth, rough, porous or non-porous materials in many different configurations in an attempt to produce as many bubbles as possible per infusion of the bubble making wand into a bubble making solution. Where most bubble making wands fail is in the amount of bubble making solution that they are able to hold in suspension per infusion and the amount of bubbles they are able to produce which is in direct correlation to the amount of bubble making solution suspended within the bubble making wand available for bubble formation. The ability to suspend the bubble making solution within the bubble making wand surface becomes more important as the bubble making solution starts to degrade and thin out. When the bubble making solution is fresh it produces a low surface tension which allows more bubble making solution to adhere to the bubble making wand's surface and produces bubbles relatively easily. As the bubble making solution starts to thin out and degrade its surface tension rises leading to reduction in bubble making ability and reduction in adherence to the bubble making wand's surface. As with all bubble making wand's bubble production will eventually meet an end point of production due to bubble making solution degradation.

BRIEF SUMMARY OF THE INVENTION

The present invention is a bubble making device. More specifically, the present invention is a bubble making wand that utilizes a plurality of helical coils and a plurality of centered spires to produce one or more bubbles from dipping the bubble making wand into a bubble making solution.

The bubble making wand helps to continue delivering bubbles as the bubble making solution starts to thin out and degrade. The position of a pair of different size helical coils and a plurality of center spires assist in securing the bubble making solution and producing bubbles especially as the bubble making solution changes in surface tension. The bubble making wand works with a wide variety of bubble making solutions and delivers improved bubble results.

The present bubble making wand includes of a pair of helical coils of different diameter wound around each other with a hollow core along with a plurality of spires protruding to the center axis wound in a circle annulus attached to a handle. The helical coils have two different diameter smooth surface wires with a strong tinsel body being able to provide self-support for the bubble making wand, spires and hollow core configuration. The hollow space between the helical coils and center core provide an effective reservoir for storage of the bubble making solution. The helical coils are wound and placed in a circular configuration providing a slow tapering surface from the outside to the center area of the core for the bubble making solution to adhere. The addition of the strategically placed spirals protruding from the center of the helical coils to the annulus greatly increases bubble production as air flow being forced around during the production of bubbles producing or infusing a wicking action from the helical coils which suspend the bubble making solution The strategically sized and placement of the spires greatly assist in the storage of the bubble making solution in the annulus as well as in bubble formation by providing a low but critical expanded surface area for bubble making solution adherence and movement during airflow in bubble production. The combination of the components, materials and design of the bubble making wand provide a greater surface area to store the bubble making solution thereby increasing the amount of bubble making solution held and released with low stress as the coherence of the bubble making solution changes increasing bubble production per infusion of bubble making solution The configuration of the two different size smooth body helical coils wound around a hollow core provide an effective reservoir for storage of the bubble making solution, forming a circle provide a slow tempered surface area for the bubble making solution to adhere and move from the outside to the center and from the hollow core of the helical coils of the bubble making wand to the centrally placed spirals.

It is an object of the invention to provide a bubble making wand that incorporates features that maximize bubble production and a plurality of greater surface areas for adherence of a bubble making solution.

It is an object of the invention to provide a bubble making wand that has greater bubble making solution retention ability, with easy bubble releasing properties that greatly increase a quantity of bubbles produced per infusion of a bubble making solution.

It is an object of the invention to provide a bubble making wand that as the bubble making solution starts to degrade the bubble making wand design provides increased surface areas for the bubble making solution to adhere to, thereby providing more available bubble making solution for producing bubbles than a traditional bubble making wand.

BRIEF DESCRIPTION OF THE DRAWINGS

The present invention will be described by way of exemplary embodiments, but not limitations, illustrated in the accompanying drawings in which like references denote similar elements, and in which:

FIG. 1 illustrates a front perspective view of a bubble making wand, in accordance with one embodiment of the present invention.

DETAILED DESCRIPTION OF ILLUSTRATIVE EMBODIMENTS

Various aspects of the illustrative embodiments will be described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations are set forth in order to provide a thorough understanding of the illustrative embodiments. However, it will be apparent to one skilled in the art that the present invention may be practiced without the specific details. In other instances, well-known features are omitted or simplified in order not to obscure the illustrative embodiments.

Various operations will be described as multiple discrete operations, in turn, in a manner that is most helpful in understanding the present invention, however, the order of description should not be construed as to imply that these operations are necessarily order dependent. In particular, these operations need not be performed in the order of presentation.

The phrase "in one embodiment" is used repeatedly. The phrase generally does not refer to the same embodiment, however, it may. The terms "comprising", "having" and "including" are synonymous, unless the context dictates otherwise.

FIG. 1 illustrates a front perspective view of a bubble wand device 100, in accordance with one embodiment of the present invention.

The bubble wand device 100 includes an elongated handle 110, a pair of helical coils 120 and a plurality of inner spires 130. The elongated handle 110 has a first end 112 and a second end 114. The first end 112 of the elongated handle 110 has a raised knob 113 to prevent the elongated handle 110 from slipping when grasped. The elongated handle 110 is made of metal, plastic or any other suitable material. The pair of helical coils 120 is a pair of smooth surface wires 122, a center core 124 and a hollow space 126 between the smooth surface wires 122 and the center core 124. The second end 114 of the elongated handle 110 has a connection support 115 to provide additional support to the pair of helical coils 120 that are attached to the second end 114 of the elongated handle 110. The pair of smooth surface wires 122 each has a different diameter. The pair of helical coils 120 are wound and placed in a circular configuration 121 providing a slightly tapered surface 123 from an exterior to a center portion of the center core 124 to allow a bubble making solution 125 to adhere to. The center core 124 provides support to the pair of helical coils 120 and the inner spires 130. The hollow space 126 between the pair of helical coils 120 and center core 124 provide a reservoir 126' to retain the bubble making solution 125. The pair of helical coils 120 and the center core 124 is made of metal, plastic or any other suitable material. The inner spires 130 protrudes from the center core 124 of the pair of helical coils 120 to significantly increase bubble production as air flow being forced around during production of the bubbles producing or infusing a wicking action from the pair of helical coils 120 which suspend the bubble making solution 125. The inner spires 130 are also made of metal, plastic or any other suitable material.

While the present invention has been related in terms of the foregoing embodiments, those skilled in the art will recognize that the invention is not limited to the embodiments described. The present invention can be practiced with modification and alteration within the spirit and scope of the appended claims. Thus, the description is to be regarded as illustrative instead of restrictive on the present invention.

What is claimed is:

1. A bubble wand device, comprising:

an elongated handle with a first end and a second end, the first end of the elongated handle has a raised knob to prevent the elongated handle from slipping when grasped;

a pair of helical coils that include a pair of smooth surface wires, a center core and a hollow space, the hollow space is between the smooth surface wires and the center core, the pair of helical coils are attached to the second end of the elongated handle and the hollow space between the pair of helical coils and center core provide a reservoir to retain a bubble making solution; and a plurality of inner spires that protrude from the center core of the pair of helical coils, the inner spires increase bubble production from the pair of helical coils which suspend the bubble making solution.

2. The bubble wand device according to claim 1, wherein the second end of the elongated handle has a connection support to provide additional support to the pair of helical coils that are attached to the second end of the elongated handle.

3. The bubble wand device according to claim 1, wherein the elongated handle is made of metal.

4. The bubble wand device according to claim 1, wherein the pair of helical coils are wound and placed in a circular configuration.

5. The bubble wand device according to claim 1, wherein the pair of helical coils provide a tapered surface to allow the bubble making solution to adhere to the pair of helical coils.

6. The bubble wand device according to claim 1, wherein the pair of helical coils is made of metal.

7. The bubble wand device according to claim 1, wherein the pair of smooth surface wires each has a different diameter.

8. The bubble wand device according to claim 1, wherein the center core provides support to the pair of helical coils and the inner spires.

9. The bubble wand device according to claim 1, wherein the center core is made of metal.

10. The bubble wand device according to claim 1, wherein the inner spires are made of metal.

11. A bubble wand device, comprising:

an elongated handle with a first end and a second end, the first end of the elongated handle has a raised knob to prevent the elongated handle from slipping when grasped;

a pair of helical coils that include a pair of smooth surface wires, a center core and a hollow space, the pair of helical coils are attached to the second end of the elongated handle, the pair of helical coils are wound and placed in a circular configuration, the pair of helical coils provide a tapered surface to allow a bubble making solution to adhere to the pair of helical coils, the pair of smooth surface wires each has a different diameter, the hollow space is between the smooth surface wires and the center core and the hollow space between the pair of helical coils and the center core provide a reservoir to retain the bubble making solution;

a plurality of inner spires that protrude from the center core of the pair of helical coils, the inner spires increase bubble production from the pair of helical coils which suspend the bubble making solution; and a connection support to provide additional support to the pair of helical coils that are attached to the second end of the elongated handle.

12. The bubble wand device according to claim 11, wherein the elongated handle is made of metal.

13. The bubble wand device according to claim 11, wherein the elongated handle is made of plastic.

14. The bubble wand device according to claim 11, wherein the pair of helical coils are made of metal.

15. The bubble wand device according to claim 11, wherein pair of helical coils are made of plastic.

16. The bubble wand device according to claim 11, wherein the center core provides support to the pair of helical coils and the inner spires.

17. The bubble wand device according to claim 11, wherein the center core is made of plastic.

18. The bubble wand device according to claim 11, wherein the center core is made of metal.

19. The bubble wand device according to claim 11, wherein the inner spires are made of metal.

20. The bubble wand device according to claim 11, wherein the inner spires are made of plastic.

* * * * *